US006058923A

United States Patent [19]

Arntz et al.

[11] Patent Number: 6,058,923

[45] Date of Patent: May 9, 2000

[54] SAW BLADE

[75] Inventors: Jan Wilhelm Arntz; Erich Huelmann, both of Remscheid, Germany

[73] Assignee: Fa. Joh. Wilh. Arntz, Remscheid, Germany

[21] Appl. No.: 09/133,277

[22] Filed: Aug. 12, 1998

[30] Foreign Application Priority Data

Aug. 13, 1997 [DE] Germany ..... 197 35 142

[51] Int. Cl.[7] ..... B28D 1/04

[52] U.S. Cl. ..... 125/15; 125/13.01; 451/542; 451/543

[58] Field of Search ..... 451/542, 543; 125/15, 13.01

[56] References Cited

U.S. PATENT DOCUMENTS

| | | |
|---|---|---|
| 4,484,560 | 11/1984 | Tanigawa . |
| 5,012,792 | 5/1991 | Kawata et al. . |
| 5,197,453 | 3/1993 | Messina . |
| 5,518,443 | 5/1996 | Fisher . |
| 5,839,423 | 11/1998 | Jones et al. . |

*Primary Examiner*—Timothy V. Eley
*Assistant Examiner*—Willie Berry, Jr.
*Attorney, Agent, or Firm*—Goodman & Teitelbaum, Esqs.

[57] ABSTRACT

The invention relates to a saw blade for cutting, slotting or grooving natural rock and synthetic construction materials, such as concrete, reinforced concrete, brick, asphalt or the like. The saw blade has a sawblade body and a plurality of segments which are arranged on the circumference of the sawblade body and are provided with radially projecting lugs which each bear an abrasive body. The segments are attached to the sawblade body by means of a thermally decoupling tongue-and-groove joint.

20 Claims, 2 Drawing Sheets

BL
BS

SAW BLADE

The invention relates to a saw blade for cutting, slotting or grooving natural rock or hard, synthetic, mineral construction materials, such as concrete, reinforced concrete, brick, ceramic, asphalt or the like.

German Utility Model DE 89 07 107 U1 has disclosed a diamond circular-saw blade which has a sawblade body with recesses arranged distributed over its circumference and lugs arranged between the said recesses. The lugs in each case extend radially outwards and, on their radially outer edge, each support an abrasive body which has a diamond coating. Two radial blind bores which are at a distance from one another and extend as far as into the sawblade body are formed in each of the lugs. Two pegs which project from the underside of the abrasive body can be pushed into the blind bores and secured by a clamping part.

The abrasive bodies can thus be attached in a releasable manner to the lugs, which are integrally formed on the sawblade body, the abrasive bodies being arranged on an end face of the lugs which lies radially on the outside.

Saw blades for cutting, slotting or grooving natural rock and synthetic construction materials, such as concrete, reinforced concrete, brick and asphalt are also known, the abrasive bodies of which saw blades are attached in an unreleasable manner, for example by soldering or laser welding. FIGS. 3 and 4 show a side view and an end view of such a saw blade 101 with soldered-on abrasive bodies 102, in the region of a lug 103. The lug 103 is formed integrally on a sawblade body 104 which consists of a steel, for example alloyed or unalloyed tool steel.

When cutting, slotting or grooving natural rock and synthetic construction materials, such as concrete, reinforced concrete, brick, asphalt or the like, the saw blade 101 is driven into the natural rock or synthetic construction material in the direction of rotation 105 at a high circumferential speed (e.g. 25 to 40 m/s). The high circumferential speed generates considerable frictional heat which needs to be dissipated using a liquid coolant. However, owing to the magnitude of the heat evolution and the fact that the rock material itself scarcely contributes to the dissipation of heat, the saw blade often becomes overheated despite the application of coolant. The overheating of the saw blade can give rise to thermal distortions in the saw blade which warp the saw blade. The teeth of a saw blade are generally not always uniformly abraded, so that the heat introduced in the region of the teeth which project further is correspondingly greater, so that thermal loading which differs in different regions and considerable distortions may result. As is known, a warped saw blade has a considerably lower sawing power than a saw blade which is aligned with a planar surface and generates a higher frictional heat, with the result that the problems caused by thermal distortion are increased still further. With considerably distorted saw blades, the cut groove is imprecise, resulting in a high level of scrap of sawn material, which in particular in the case of expensive rock material, such as for example marble or granite, may impose substantial costs.

In order to avoid warpage of the saw blade as a result of thermal loads, it is obvious to produce the saw blade from a higher-grade and harder steel which is better able to withstand the thermal loads.

However, steels of higher hardness cause considerable problems in the production of a saw blade, since the high hardness means that the steels cannot be straightened and tensioned at acceptable cost. In addition, large-area saw blades cannot be hardened homogeneously with a hardness of, for example, $\geqq 52\ H_{RC}$, with the result that inhomogeneous regions of different strengths, and in particular regions of different tensioning, in the saw blade are produced. Under thermal loads, these inhomogeneous regions lead to increased warpage of the saw blade, so that even saw blades made from steels of relatively high hardness are not significantly more stable at high temperatures than saw blades made from steels with a lower hardness. Moreover, a higher-grade steel would increase the costs of a saw blade significantly, so that it is scarcely viable in economic terms. In practice, it has been found that only steels having a maximum hardness of up to approx. 52 $H_{RC}$ are a rational choice for saw blades.

FIG. 4 shows a tooth of a saw blade 101 after it has been used to machine rock material. When machining abrasive material to be cut of this nature, such as rock material, the lugs 103 become abraded in the region of their lateral flank 106. They are abraded and substantially weakened in particular at the region adjoining the abrasive bodies 102, so that the contact surfaces 107 between the abrasive bodies 102 and the lugs 103 are reduced. A smaller contact surface 107 also means a reduced strength of the connection between the abrasive body 102 and the lug 103. A small contact surface 107 of this nature may make re-tipping impossible after an abrasive body 102 has become detached.

To summarize, therefore, it can be stated that although there are saw blades available for cutting, slotting or grooving natural rocks and synthetic construction materials, owing to the enormous thermal loads these blades are subject to considerable thermal distortions which have an adverse effect on the quality of cut, on the service life of the saw blade and on the cutting power. In addition, the saw blades which are formed from relatively soft steel are subject to considerable wear owing to the abrasive properties of the rock material.

Saw blades which have radially projecting teeth on a sawblade body for sawing wood, metal and the like are known. The teeth are generally formed integrally on the sawblade body, and are ground and hardened.

DE 36 18 545 A1 discloses a segmental circular-saw blade with a sawblade body which on its periphery has a sawblade-body web of reduced thickness, over which there engage segments bearing a cutting tooth which are attached by means of rivets. A segment comprises a segment body which, in the region of the lower segment edge, has a U-shaped longitudinal slot which is formed by tabs on two sides. The free end edges of the tabs are formed in the shape of a concave arc and rest on the shoulders of correspondingly convex design which are arranged on both sides next to the sawblade-body web.

Segmental circular-saw blades of this kind for sawing metal have long been known and have proven useful in practice. Owing to the lower hardness of the material and the slower cutting speed, the thermal load on saw blades used for machining metal, wood or the like cannot be compared with those on saw blades used for cutting natural rocks, concrete blocks, ceramic or similar mineral, hard construction materials.

The invention is based on the object of providing a saw blade for cutting, slotting or grooving natural rock and synthetic construction materials, such as concrete, reinforced concrete, brick or asphalt or the like, which blade is stable at high temperature, has a long service life and can be produced in a cost-effective manner.

This object is achieved by means of a saw blade having the features set forth below. Advantageous configurations of the invention are also characterized below.

According to the invention, a saw blade is provided which is formed from a sawblade body and a plurality of segments which are arranged on the periphery of the sawblade body and are attached by a thermally decoupling tongue-and-groove joint. The segments have radially projecting lugs which bear abrasive bodies and are attached to the sawblade body by means of rivets.

This rivet-secured plug-in connection interrupts the transfer of heat from the blade circumference, i.e. from the segments, to the sawblade body, since gaps are present between the tongue and the groove, for example as a result of providing a separating gap and/or rough tolerances on tongue and groove and/or shallow recesses on the tongue and/or the groove. The gaps may also be filled with a thermally decoupling layer. When machining—cutting, slotting, grooving or the like—, the frictional heat generated remains predominantly in the region of the segments and, from the latter, is transmitted directly to a coolant. As a result, the thermal load on the sawblade body is kept very low.

Even at high temperatures, only minimal mechanical distortions take place on the segments, which are small by comparison with the sawblade body, so that the saw blade as a whole is in an excellent position to withstand the enormous thermal stresses.

The segmented design of the saw blade produces a surprisingly high stability at high temperatures, so that the enormous thermal loads produced when machining natural rock or construction materials can be taken up by the saw blade without warpage and a long service life is achieved.

In a preferred embodiment, the segments consist of a steel of high hardness or are hardened by heat treatments or the like. Owing to the relatively small surface area of the segments, this can be achieved with little technical effort and at low costs, the lugs, which support the abrasive bodies, of these hard segments having a high wear resistance and remaining dimensionally stable over a long service life, with the result that a sufficient contact area between the lugs and the abrasive bodies is ensured over the long service life.

The invention is explained in more detail below, by way of example, with reference to the drawings, in which.

Figures 1, 2:
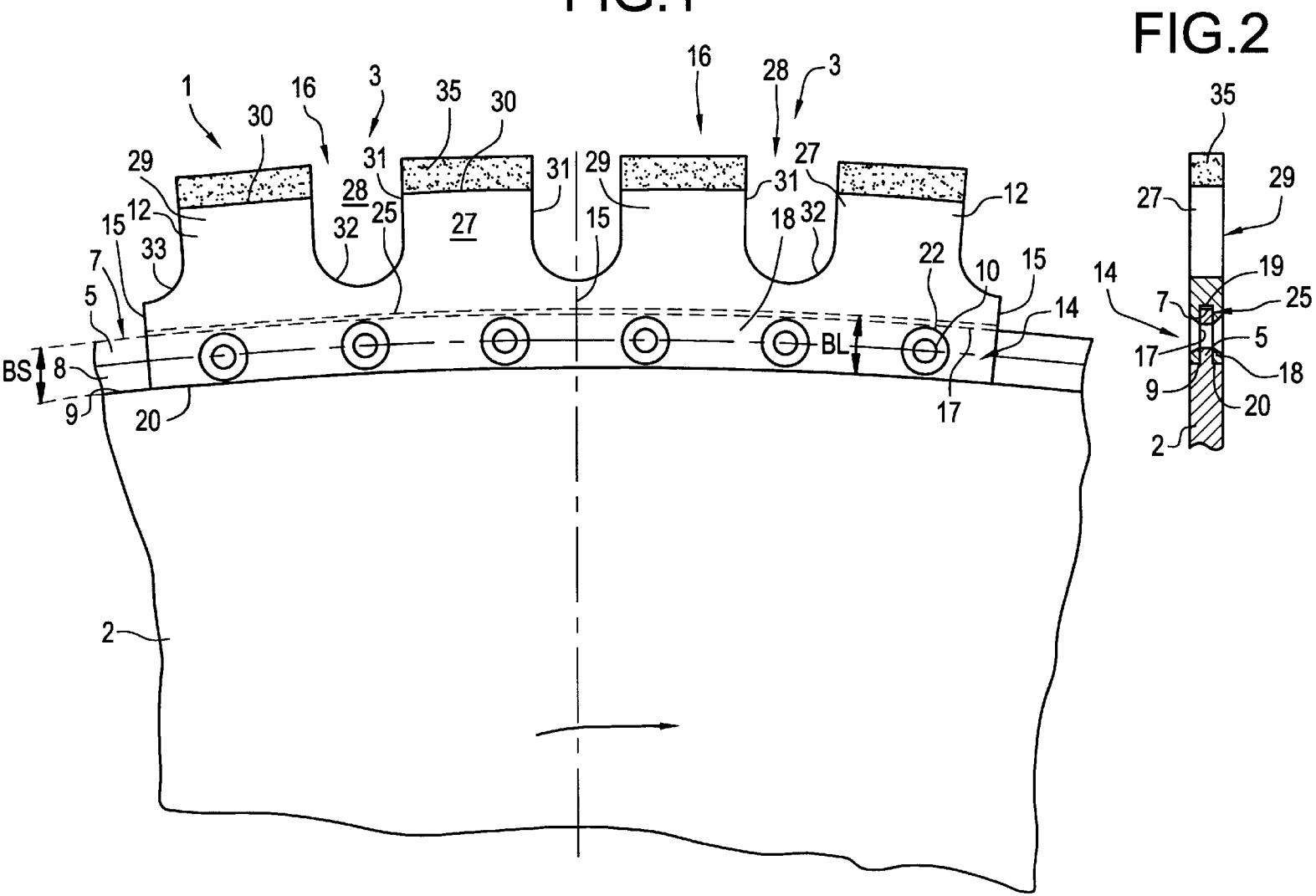
FIG. 1 shows the side view of a saw blade 1 in the region of two segments.
FIG. 2 shows a section through the saw blade from FIG. 1 in the region of a lug.
Figure 3:
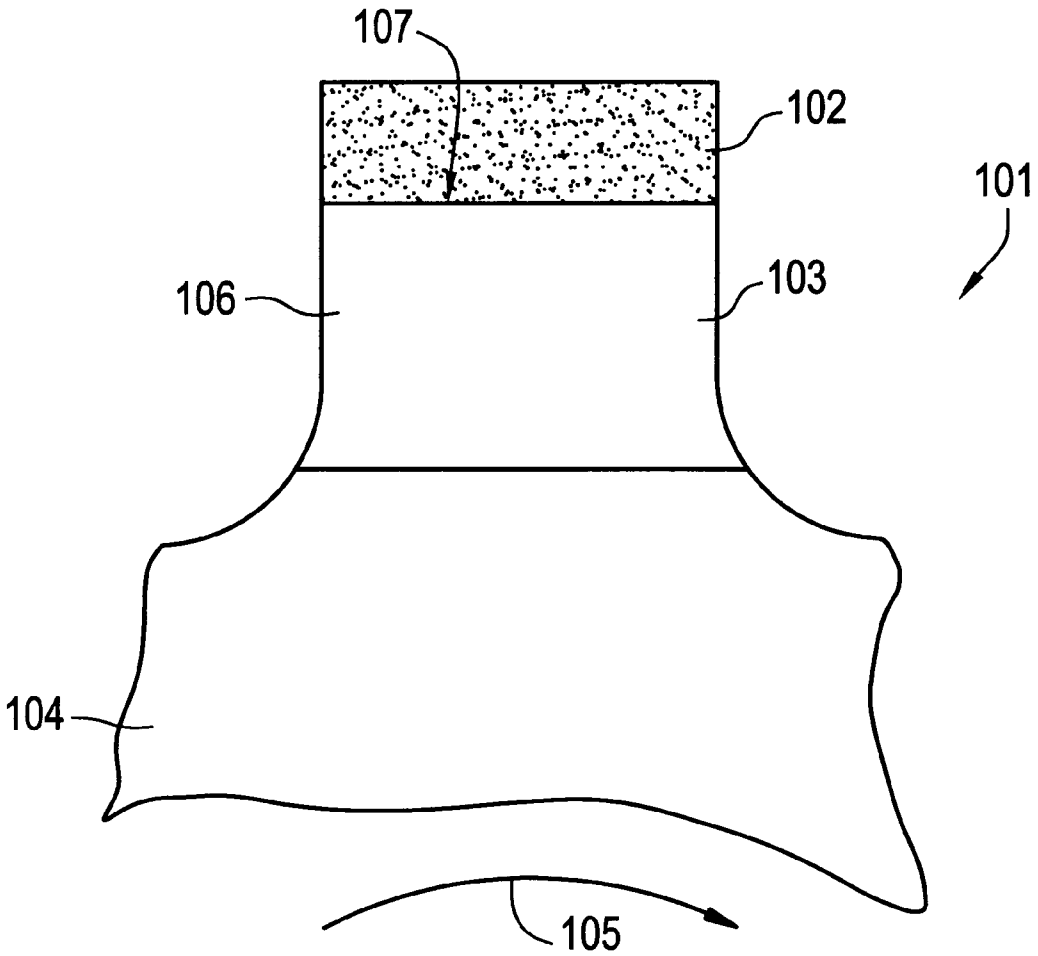
FIG. 3 shows a side view of a known saw blade in the region of a saw tooth.
Figure 4:
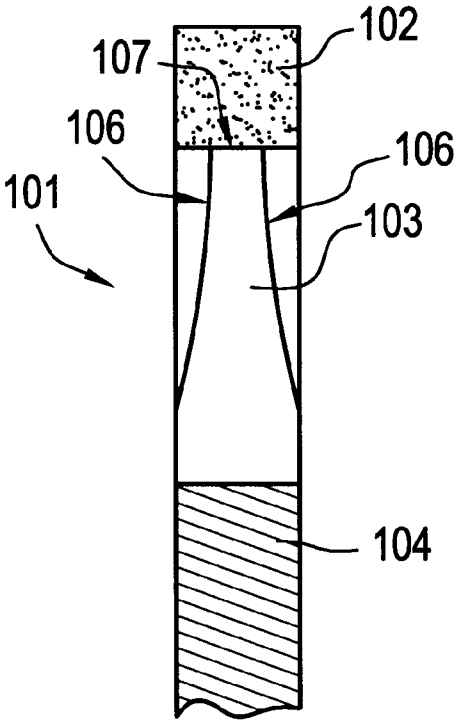
FIG. 4 shows an end view of the saw tooth illustrated in FIG. 3.

The saw blade 1 has a sawblade body 2 and a plurality of segments 3 arranged on the periphery of the sawblade body 2.

The sawblade body 2 is a circular disc with one or more orifices (not shown) arranged centrally, in a manner known per se, for attaching the saw blade 1 to a shaft of a saw device.

A sawblade-body web 5 is formed running round the circumference of the sawblade body 2, which web is thinner than the thickness of the sawblade body 2. The sawblade-body web 5 has an approximately rectangular cross-section with a free end edge 7 and two side walls 8. It is arranged centrally on the sawblade body 2, so that two shoulder surfaces 9, which run at right angles to the side walls 8, are arranged on the sawblade body 2. Rivet holes 10, which are arranged on a circular line, are formed at predetermined, regular intervals in the sawblade-body web 5.

The sawblade body 2 is formed from an alloyed or unalloyed tool steel with a maximum hardness of 52 $H_{RC}$. Preferably, the hardness of the sawblade body 2 is less than 50 $H_{RC}$.

The segments 3 each comprise a segment body 12. The segment body 12 is a platelike ring segment having a connecting-edge region 14 arranged radially on the inside, two end edges 15 and a saw-tooth region 16 arranged radially on the outside.

The connecting-edge region 14 has a U-shaped longitudinal groove 17 which is formed by two lateral tabs 18. The two tabs 18 between them delimit a groove base 19. The free end edges 20 of the tabs 18 are, when seen from above, curved in the form of a concave arc. Aligned rivet holes 22 for attaching a segment 3 to the sawblade body 2 are formed in the tabs 18.

The U-shaped longitudinal groove 17 of the segments 3 is positioned on the sawblade body 2, engaging over the sawblade-body web 5, and the segments are attached to the sawblade body 2 by means of rivets which pass through the rivet holes 10, 22. The width BL of the tabs 18 is slightly greater than the width BS of the sawblade-body web 5. The concavely curved free end edges 20 of the tabs 18 are therefore supported on the shoulder surfaces 9, which are correspondingly convexly curved, and the groove base 19 is arranged at a distance from the free end edge 7, so that between them they delimit an annular gap 25.

In addition to, or as an alternative to, the annular gap 25, the longitudinal grooves 17 and/or the sawblade-body web 5 may be formed with rough tolerances and/or have shallow recesses, in order to provide thermally decoupled air chambers or air pockets in the region of the free end edges 20 and/or side walls 8 and/or the shoulder surfaces 9.

One or more lugs 27 which project radially outwards are formed integrally on the segment body 12, which lugs between them delimit a recess 28 which is U-shaped in plan view. The lugs 27 each have two side walls 29, a free end edge 30, which is curved convexly along a circular line, and two radially running end edges 31. The end edges 31 are connected in the region of the recesses 28 by a concave, semicircular arc 32 and a concave arc 33 in the form of a quarter-circle adjoins the end edges 31 of the lugs 27 which are arranged adjacent to the end edges 15 of the segments 3. The arcs 33 in the form of a quarter-circle each end perpendicular to the end edges 15 of the segments 3.

The segment bodies 12 preferably consist of a hard material, such as for example super high-speed steel, heat-treated steel or of steel which has been hardened by conventional methods, or the like. The segment bodies 12 have a hardness of more than 52 $H_{RC}$ and preferably of more than 55 $H_{RC}$.

The surface of the segments 3, in particular in the region of the side walls 29 of the lugs 27, is expediently coated with hard material or hardened on the surface.

An abrasive body 35 is attached to each of the free end edges 30 of the lugs 27, for example by means of a soldered, welded or plug-in connection. The abrasive body 35 has a metal basic body which is covered with an abrasive coating. Abrasive coatings of this nature have grains of diamond, corundum, silicon carbide or some other non-metallic, inorganic grinding material.

The groove 17 of the segments 3 is positioned on the circumference of the sawblade body 2 on the sawblade-body web 5 in the manner of a tongue-and-groove joint, the annular gap 25 forming a separating gap between the sawblade-body web 5 and the groove base 19, which gap interrupts the transfer of heat from the saw teeth, which each comprise a lug 27 and an abrasive body 35, to the sawblade body 2. When machining, i.e. when cutting, slotting, grooving and the like, natural rock or synthetic construction materials, the frictional heat generated remains for the most part in the region of the segments 3 and, from the latter, is transmitted directly to a coolant. As a result, the thermal load on the sawblade body 2 is kept very low. Even at high temperatures, only minimal mechanical distortions take place on the segments 3, which are designed with a small surface area by comparison with the sawblade body 2, so that the saw blade 1 as a whole is able to withstand the enormous thermal stressing surprisingly well.

Furthermore, the saw blade according to the invention for machining natural rock or hard, synthetic, mineral construction materials has the following advantages:

The sawblade body 2 and the segments 3 may consist of different materials, the segments preferably being formed from harder, more highly heat-treated steel than the sawblade body 2.

Owing to their relatively small size, the segments 3 may be hardened by means of a heat treatment or the like, with the result that the toughness and hardness are improved. This reduces the wear to the lugs, increases the service life and improves the quality of cut, since the attachment between abrasive bodies 35 and the lugs 27 is ensured over a long service life.

Saw blades with different geometries with regard to the saw-tooth region 16 can be produced economically, since it is merely necessary to modify the shape of the segments which are positioned on the sawblade body 2.

Worn, damaged segments can be exchanged for new ones, so that the sawblade is repairable.

The friction in the region of the tongue-and-groove joint and the mutually abutting end edges 15 reduces the generation of noise.

Owing to the segment-like design of the saw blade, compensation between compressive and tensile stresses takes place.

The invention is not limited to the exemplary embodiment explained above; a person skilled in the art may readily, within the context of his/her specialist knowledge, find further modifications. Thus, by way of example, the groove of the tongue-and-groove joint may be formed not on the segments but on the sawblade body, the segments each having a corresponding web which can be inserted into the groove as the tongue. The free end edges 30 of the lugs 27 may, for example, be designed so that they run in a straight line, the abrasive bodies 35 having correspondingly rectilinear bearing edges. In such an embodiment, the abrasive bodies 35 may be produced independently of the diameter of the saw blade and attached to the segments 3.

In a refinement of the invention, a layer of heat-resistant plastic, such as polytetrafluoroethylene or the like, may be introduced between the longitudinal groove 17 and the sawblade-body web 5, which layer bears against side walls of the sawblade-body web 5 and/or against the shoulder surfaces 9. This layer serves to improve the thermal decoupling between the segments 3 and the sawblade body 2.

What is claimed is:

1. Saw blade for cutting, slotting or grooving natural rock or hard, synthetic, mineral construction materials, such as concrete, reinforced concrete, brick, ceramic, and asphalt, comprising:

a sawblade body (2), a plurality of segments (3) being arranged on a circumference of the sawblade body (2), the segments (3) having radially projecting lugs (27), each of the lugs (27) being provided with an abrasive body (35);

positioning means for positioning the segments (3) on the sawblade body (2), said positioning means including a thermally decoupled tongue-and-groove joint provided with a tongue (5) and a groove (17);

the tongue (5) being a sawblade body web (5) disposed around the circumference of the sawblade body (2), the web (5) being thinner than a thickness of the sawblade body (2) to provide two shoulder surfaces (9) on the sawblade body (2) on opposite sides of the web (5);

the groove (17) being provided at a connecting-edge region (14) of the segments (3), the connecting-edge region (14) including two lateral spaced-apart tabs (18), and a groove base (19) disposed between the tabs (18) to define the groove (17), the tabs (18) having free end edges (20), the tabs (18) also having a width (BL) slightly greater than a width (BS) of the sawblade body web (5); and the groove (17) engagingly receiving the web (5) therein so that the free end edges (20) of the tabs (18) are support against the shoulder surfaces (9) of the sawblade body (2), and the groove base (19) is arranged at a distance from a free end edge (7) of the sawblade body web (5) to provide an annular gap (25), the annular gap (25) disposed between the free end edge (7) and the groove base (19) provides a separating gap.

2. Saw blade according to claim 1, wherein the groove (17) and/or the tongue (5) are provided with a rough tolerance.

3. Saw blade according to claim 1, wherein shallow recesses for providing one or more chambers are disposed in the groove (17) and/or the tongue (5).

4. Saw blade according to claim 1, wherein a layer of heat-resistant plastic, such as polytetrafluoroethylene, is disposed between the groove (17) and the tongue (5).

5. Saw blade according to claim 1, wherein the sawblade body (2) is circular disc.

6. Saw blade according to claim 5, wherein the sawblade-body web (5) is provided with a rectangular cross-section with the free end edge (7) and two side walls (8) and is arranged centrally on the sawblade body (2), so that the two shoulder surfaces (9) run at right angles to the side walls (8).

7. Saw blade according to claim 1, wherein the segments (3) are fabricated from a harder material than the sawblade body (2).

8. Saw blade according to claim 7, wherein the sawblade body (2) is fabricated from a tool steel with a maximum hardness of 52 $H_{RC}$.

9. Saw blade according to claim 8, wherein in the hardness of the sawblade body (2) is less than 50 $H_{RC}$.

10. Saw blade according to claim 7, wherein the segments (3) are fabricated from a material with a hardness of more than 52$H_{RC}$.

11. Saw blade according to claim 10, wherein the segments (3) are fabricated from a material with a hardness of more than 55 $H_{RC}$.

12. Saw blade according to claim 1, wherein the segments (3) are coated with hard material or are surface-hardened.

13. Saw blade according to claim 1, wherein the segments (3) are fabricated from super high-speed steel, heat-treated steel or sintered carbide.

14. Saw blade according to claim 1, wherein the abrasive body (35) has an abrasive coating for machining natural rocks and synthetic construction materials, the abrasive coating having grains which consist of diamond, corundum, and silicon carbide.

15. Saw blade according to claim 1, wherein the segments (3) are each part of a segment body (12), which is a platelike ring segment having the connecting region (14), two end edges (15) and a saw-tooth region (16) arranged radially outside.

16. Saw blade according to claim 15, wherein the free end edges (20), when viewed from above, are curved to provide a concave arc.

17. Saw blade according to claim 16, wherein aligned rivet holes (10, 22) are provided in the tabs (18) and in the sawblade-body web (5), rivets passing through each of the rivet holes for attaching the segments (3) to the sawblade body (2).

18. Saw blade according to claim 1, wherein the lugs (27) each have an end edge (30) which faces freely outwards in the radial direction and on which the abrasive bodies (35) are arranged by a releasable or unreleasable connection including a soldered, welded or plug-in connection.

19. Saw blade according to claim 18, wherein the end edge (30) is convexly curved.

20. Saw blade according to claim 18, wherein the free end edges (30) of the lugs (27) run in a straight line.

* * * * *